United States Patent [19]

Graeff et al.

[11] Patent Number: 4,729,278

[45] Date of Patent: Mar. 8, 1988

[54] VERTICAL ROTARY BRAIDER

[75] Inventors: Barry L. Graeff; Rudolf H. Haehnel, both of Reading; Vincent A. Iannucci, Westlawn, all of Pa.

[73] Assignee: Rockwell International Corporation, Pittsburgh, Pa.

[21] Appl. No.: 45,113

[22] Filed: May 4, 1987

[51] Int. Cl.[4] ..... D04C 3/42; D04C 3/02

[52] U.S. Cl. ..... 87/48; 87/33; 87/44

[58] Field of Search ..... 87/44–48, 87/29, 30, 32–34, 14–17

[56] References Cited

U.S. PATENT DOCUMENTS

| | | | |
|---|---|---|---|
| 1,058,100 | 4/1913 | Rankin | 87/46 |
| 2,464,899 | 3/1949 | Sokol | 87/48 |
| 2,672,071 | 3/1954 | Marogg | 87/46 |
| 3,834,271 | 9/1974 | Hinds et al. | 87/46 |
| 3,892,161 | 7/1975 | Sokol | 87/44 X |
| 4,034,642 | 7/1977 | Iannucci et al. | 87/48 |
| 4,130,046 | 12/1978 | Sokol | 87/48 |
| 4,372,191 | 2/1983 | Iannucci et al. | 87/48 |
| 4,535,674 | 8/1985 | Bull et al. | 87/29 |
| 4,620,473 | 11/1986 | Bull | 87/48 |

*Primary Examiner*—John Petrakes

[57] ABSTRACT

A braiding machine having inner and outer tables mounted for counter-rotation about a vertical axis, a stationary, standing rib cam positioned beneath the outer table, a strand guide arm supported on the outer table and having a guide eye that travels in an arcuate path in which all points in the path are equidistant from the strand braid point and connecting and driving elements operably joining the rib cam and the guide eye arm to effect positive arcuate movement of the guide arm.

6 Claims, 5 Drawing Figures

38
31
37
45
40
30
36
35
10

VERTICAL ROTARY BRAIDER

FIELD OF THE INVENTION

This invention relates to braiding machines and more particularly to braiders in which the braiding is being effected in the vertical direction, usually to apply a braided reinforcing or protective layer to the external surface of an elongated substrate, such as a hose carcass. As is known, rotary braiding machines involve the utilization of inner and outer arrays of bobbins spaced circumferentially around inner and outer counter-rotating tables. From these bobbins are fed braid strands in a manner whereby they are shifted radially inwardly and outwardly, with respect to each other, to produce the braided overlay.

BACKGROUND OF THE INVENTION

Description of the Prior Art

In the past, braiding machines have been of two basic types, one in which bobbins have been guided to move in sinusoidal, overlapping paths which creates the braid and the other in which the bobbins move counter-directionally on counter-rotating tables and braid strand guide elements or fingers are used to move the strands of the outer bobbin array over and under the strands of the inner bobbin array to create the braiding action. In each type of braider, the structural requirements are stringent since, if the apparatus is to be economically useful, it should be capable of operating at productive speeds. Obviously as the operating speed of such machines is increased, the engineering problems also increase and at a faster rate than does machine speed. The problems associated with moving relatively large masses at high speed means that tight machine tolerances are necessary and that all moving and driving elements should be under positive control at all times.

There exist in the prior art examples of that class of braiders in which braid strand guides are used in conjunction with the strands of the outer bobbins. Marrog U.S. Pat. No. 2,672,071 which issued 3/16/54 describes the such example.

In this Marrog patent, the braid strand is fed from a plurality of bobbins 16 which are carried on the outer table 10 that is arranged to move in counter-rotation with respect to the upper or inner table 11. The strand 19 which comes from bobbin 16 is fed upwardly around a plurality of guiding rollers and finally, through a housing 24. Mounted on the housing 24 is a guide tube 27 through which the strand 19 exits in the manner clearly shown in FIGS. 3 and 4 of the drawings. In order to move the strands 19 alternately over and under the strands 17, it is necessary that the guide tubes 27 be moved in an oscillating fashion about the axis of the outer housings 24. This is accomplished by means of a ball joint 33 and a link 32 which is attached to the guide tube 27 in the fashion shown. The other end of links 32 are connected to cam followers 34. The cam followers ride in a slot 35 in the cylindrical cam plate 36. Thus it can be seen that as the cam follower 34 travels in the cam path 35 the guide tube 27 will be moved alternately above and below the inner bobbins 14 which carry the inner strands 17. In this arrangement it is quite clear that the length of the strand 19 coming from the guide tube 27 and going to the braid point remains substantially constant, this being a feature which is required if strand tension is to be maintained constant between the guide tube and the braid point.

While the Marrog apparatus does manage to keep the strand tension substantially constant between the strand exit and the braid point, the manner in which the guide tubes are oscillated limits the speed at which operation can be effected. Because the cam follower 54 must contact different sides of cam track during the path of travel, this restricts the speed of operation because the cam follower is not under positive control at all times and excessive increase in speed will cause severe vibration to be initiated.

A second example of that class of machines which utilizes strand guide fingers in conjunction with the outer array of bobbins may be found by referring to the Sokol U.S. Pat. Nos. 2,464,899 and 3,892,161. In each instance here the outer strand is guided over and under the inner strands by means of guide fingers which move radially inwardly and outwardly with respect to the axis of rotation of the machine tables. This is a less than desirable condition because the length of the strand varies with respect to the braid point and when the strand length varies in this fashion tension cannot be maintained constant.

It is therefore a principal object of this invention to provide an improved braiding machine of the type in which the outer strands are controlled and can be operated successfully at high speeds while maintaining constant strand tension.

Another object of this invention is to provide a strand guide system for a vertical braiding machine which is at all times positively driven.

A further object of this invention is to provide a strand guide system for a vertical braiding machine which is simple, rugged and thereby permits higher operating speeds than was heretofore possible.

Yet another object of this invention is to provide a strand guide system for the outer strands of a vertical braider in which a guide finger is operatively connected to a cam/cam follower drive means that maintain positive control over the finger at all times.

These and other objects and advantages of this invention will be in part obvious and in part explained by reference to the accompanying specification and drawings, in which.

DESCRIPTION OF PREFERRED EMBODIMENT

Figure 1:
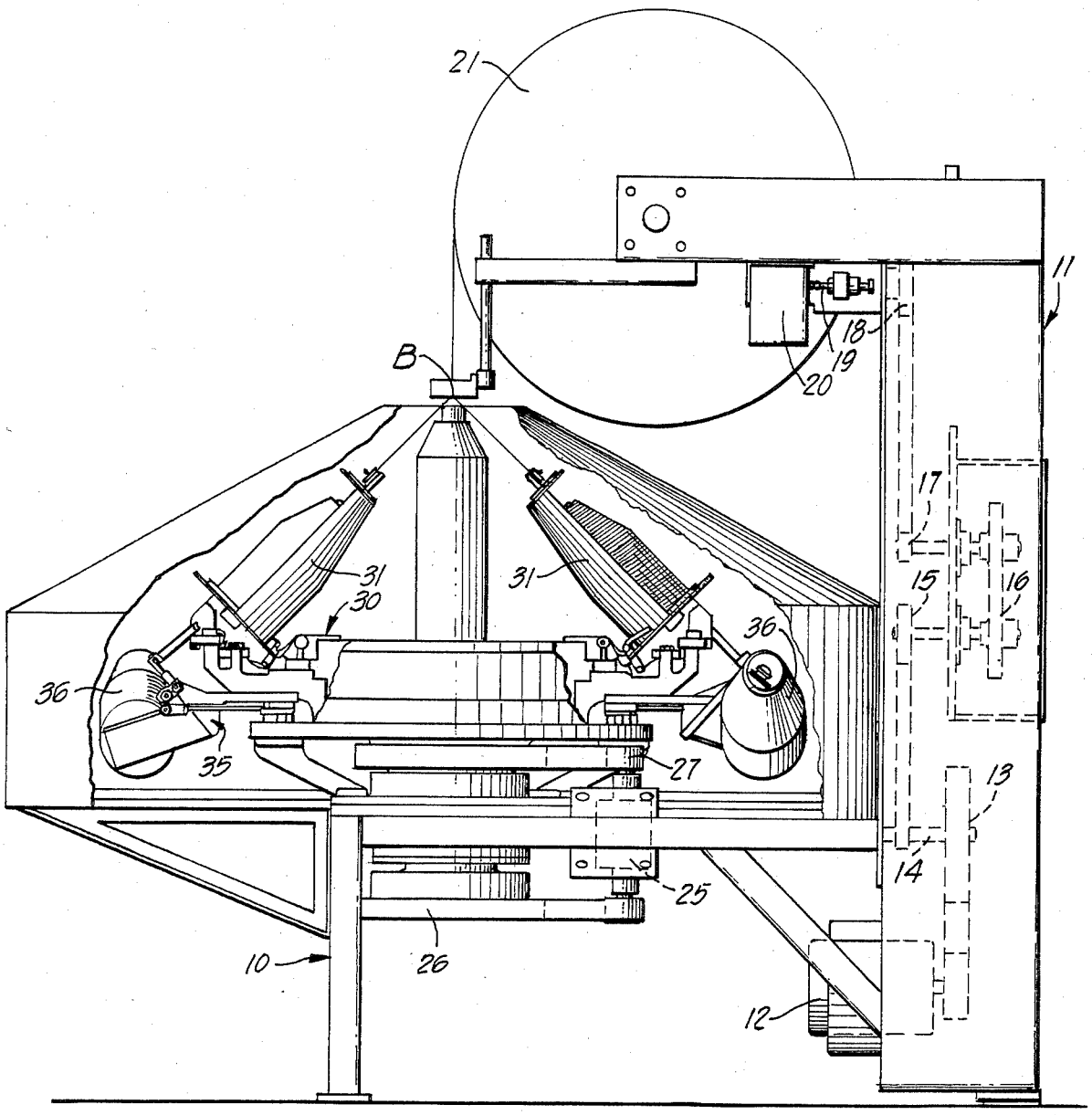
FIG. 1 is a partly schematic side election, with parts broken away, showing the type of braiding machine with which this invention is concerned.
Figure 2:
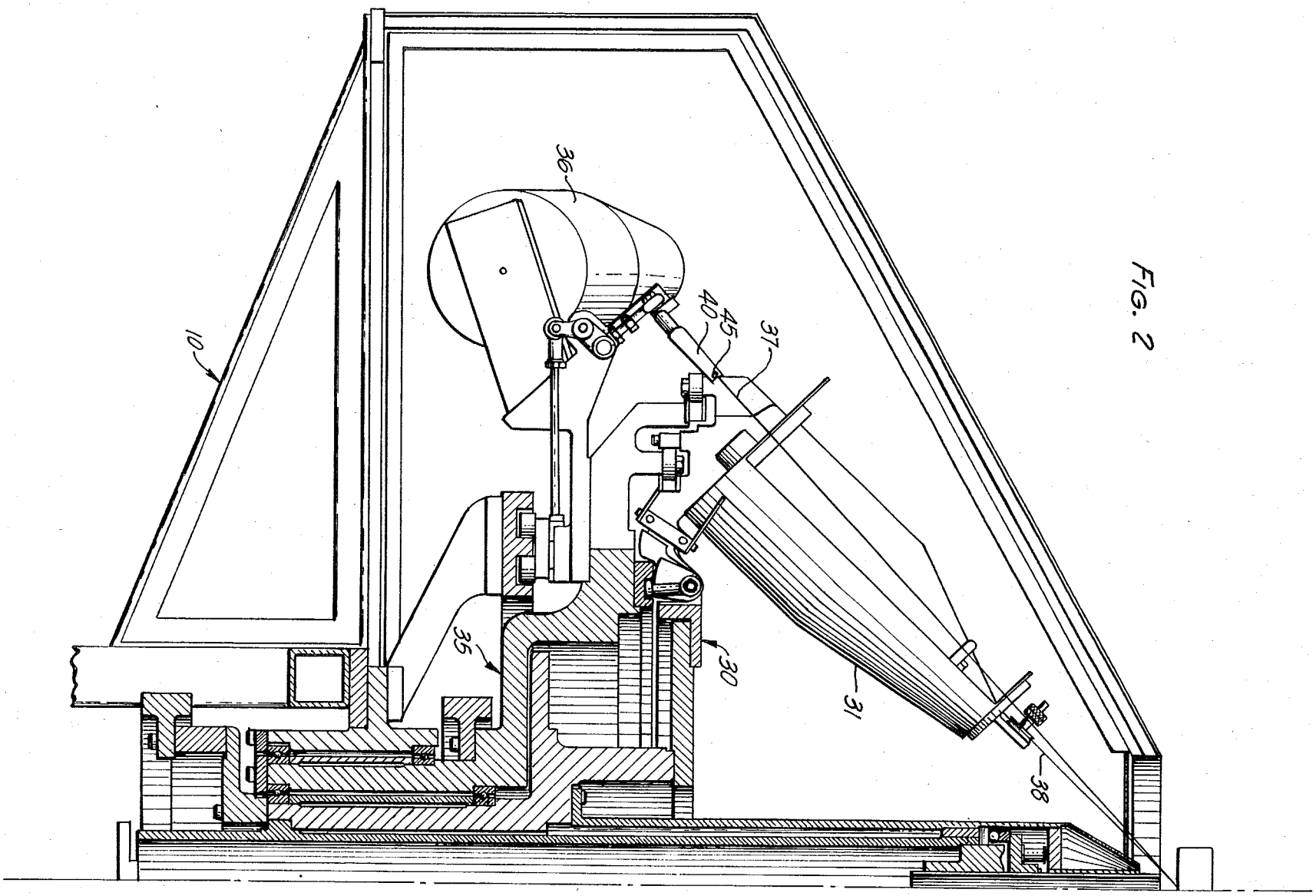
FIG. 2 is a side elevation showing the overall strand guide/strand guide drive mechanism.

In order to understand the present invention more clearly, reference is made to the figures and particularly to FIG. 1 which shows a general side elevation of the entire braiding machine. In this figure, it can be seen that the braiding machine itself is supported by appropriate frame work indicated by the numeral 10. To the right of the machine, as viewed in FIG. 1, there is a vertical component or housing 11 that encloses most of the drive mechanism of the braiding machine. Specifically, drive motor 12 is operatively connected to a pulley 13 carried on shaft 14. Turning of the shaft 14 in turn operates a pulley 15 and through transfer gears 16 acts to turn the pulley 17 and ultimately the uppermost pulley 18. Uppermost pulley 18 turns the horizontally extending shaft 19 that drives a reducer gear 20. This drive mechanism is used to turn the takeup wheel 21 upon which completed product is collected. This drive mechanism just described for rotating the takeup wheel is common in existing braiding machines and forms no part of the present invention.

The horizontally extending shaft 14 which is turned by pulley 13 from drive motor 12 extends outwardly into a reducer 25 that contains bevel gears that are utilized to drive a belt 26 for effecting rotation of one table of the braiding apparatus and a belt 27 which is used to effect driving of the other table of the braiding machine. As is the case with most braiding machines, there is provided an inner table 30 which contains an array of bobbins 31 that are spaced circumferentially around the table. This table is driven by the belt 26. Also provided is an outer table 35 which also contains an array of bobbins, 36, that are spaced circumferentially around its circumference. This table is driven by the upper belt 27. In operation, the bevel gears contained in the reducing mechanism 25 cause the tables to be rotated in counter rotation with respect to each other.

When the braiding operation is being performed, the strand 37 coming from the outer bobbin array 36 must rise above and below the inner bobbins 31 so that they can alternate with the strands 38 that are being fed from the inner bobbin array 31. Both strands 37 and 38 are delivered to the braid point of the machine, which is indicated by the number B in FIG. 1 of the drawings. In order to obtain a good braided product, it is obvious that the strand 37 from outer bobbins 36 must be kept of uniform length during its movement above and below the inner bobbin array 31 in order that the tension in the strand be kept constant.

The present apparatus includes means whereby the strand 37 can be maintained of constant length and of constant tension. Specifically, guide means are supported on the outer table for pivotal movement about a pivot axis which passes through the braid point B to provide a guide exit point that travels in an arcuate path in which all points contained in the path are equidistant from the braid point B. This guide means takes the form of a finger 40 that is attached at the pivot axis 42 to a plate like supporting bracket 43 that is secured to the underside of the outer table 35. The finger 40 provides a guide exit point 45 that moves in an arcuate path that is always the same distance from the braid point B.

It is obvious that in order to oscillate the strand guide finger at a high rate of speed with the surety required for successful braiding operations, means must be provided to drive the guide finger. This means must be positively driven in each direction with no slack permitted. There is provided stationary means located beneath the outer table 35 that acts as the source of driving motion for strand guide fingers 40. Specifically, there is provided a stationary cam 50 that has a stationary standing rib 51 that is located directly beneath the outer table 35. The drive means for effecting positive oscillation of strand guide finger 40 in opposite directions about the pivot axis 42 include operator means attached to the underside of the outer table 35 which has cam follower means dependent therefrom, which means come into operative contact with each side of the standing rib portion 51 of the cam 50. A portion of this operator means is positively displaced toward and away from the braiding machine vertical axis as the outer table is rotated.

Figure 3:
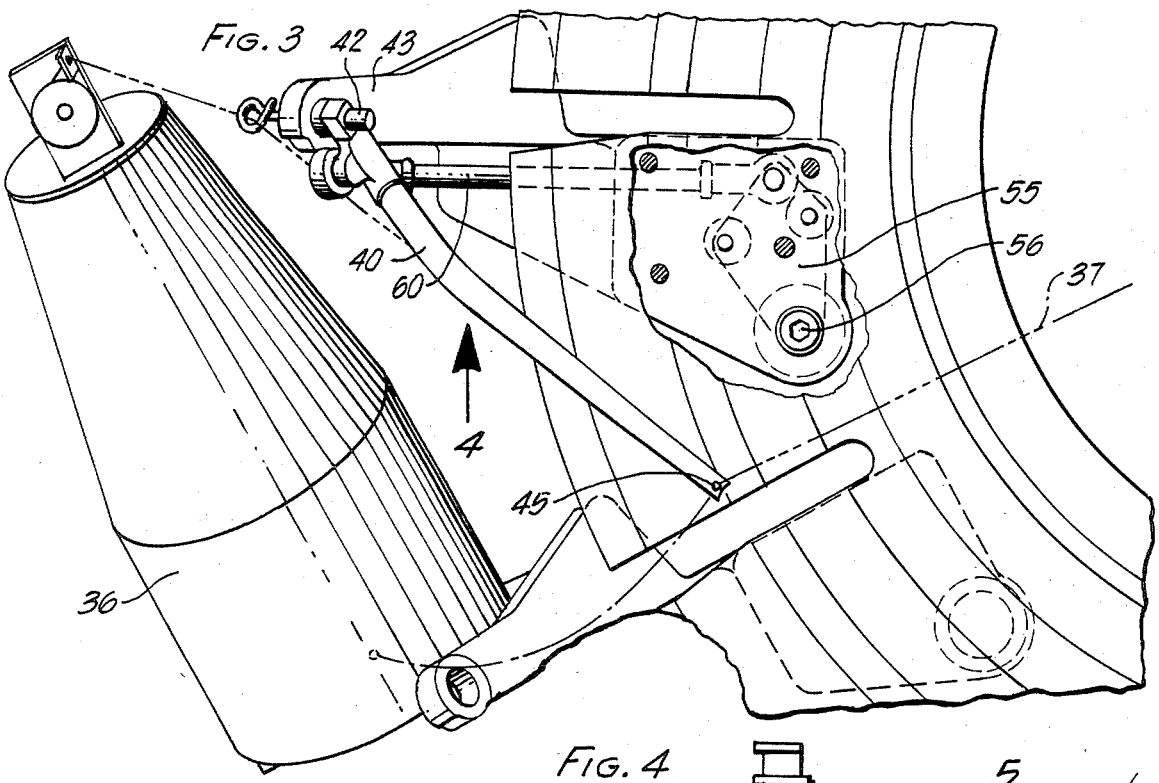
FIG. 3 is top elevation of one of the strand guide/strand drive mechanism with parts broken away for clarity.
Figure 4:
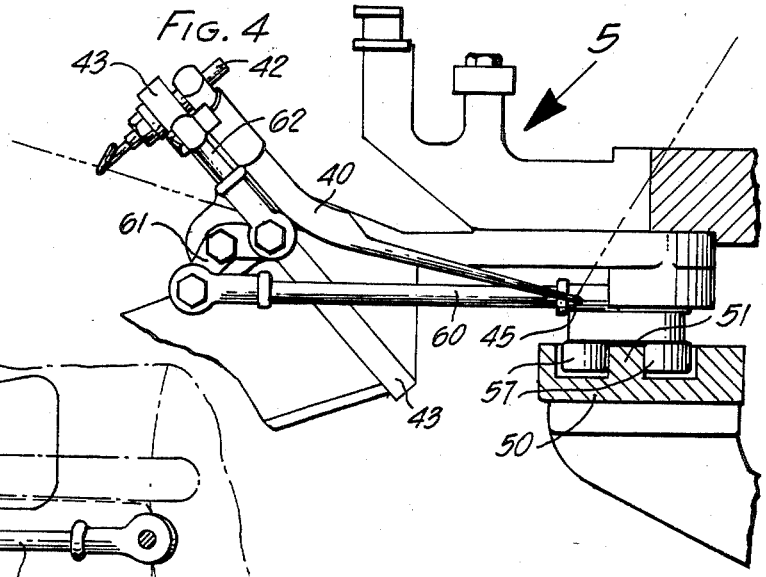
FIG. 4 is somewhat enlarged side elevation of the strand guide/strand drive mechanism.
Figure 5:
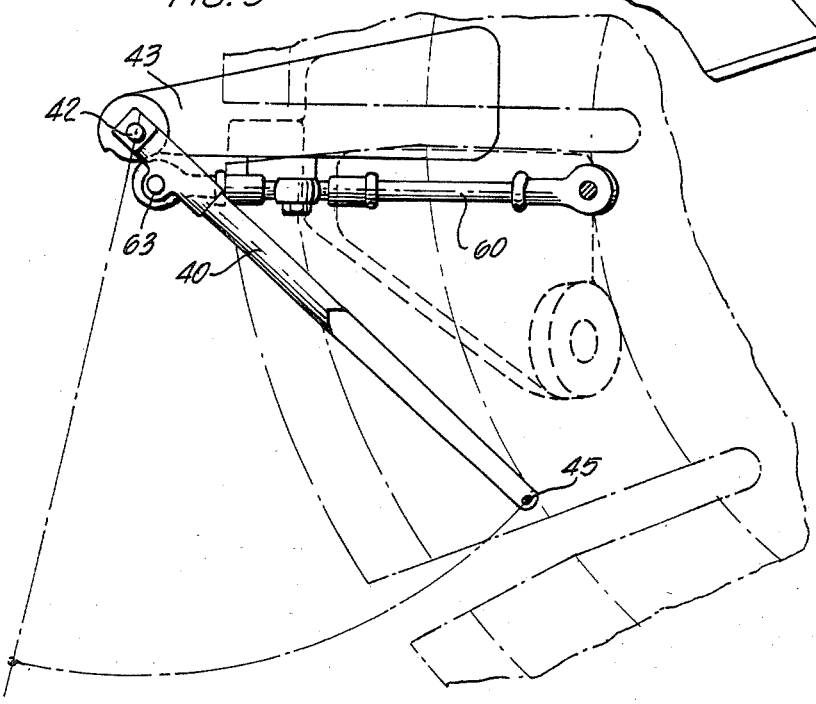
FIG. 5 is a top elevation taken from a different angle than that of FIG. 3 to more clearly show the connection between the strand guide drive and the strand guide finger.

Referring more specifically to FIG. 3, the operator means comprises an operator lever which is here shown in the form of a plate-like element 55 whose sides enclose two obtuse and two acute angles. The operator means 55 is pivotally attached to the underside of the outer table at the axis 56 and has dependent therefrom two cam followers 57 which abut each side of the standing rib 51. Thus, as the outer table 35 rotates, the cam followers 57 must follow the path defined by the standing rib 51. Since each side of the standing rib 51 is in contact with a cam follower it is apparent that the operator lever will pivot toward and away from the machine axis about the axis 56 as travel occurs. It can be seen in FIG. 3 of the drawings that the pivot axis 56 is contained within one of the acute angles defined by the walls of the operator means 55. At the other acute angle end there is pivotally attached push rod means 60 which extends outwardly toward the location where strand guide finger 40 is pivotally connected to the support 43. At its outer end the push rod 60 is pivotally connected to a bell crank-like lever 61 which is in turn connected to a relatively short push rod 62. The other end of push rod 62 is operably connected at the other end to the strand guide means 40 at the pivot point 63, as best seen in FIG. 5 of the drawings, so that movement of the push rod will result in arcuate movement of the strand guide means 40.

From the preceding description, it can be seen that the braiding machine of this invention includes an improved means for operating a strand guide finger in rapid oscillating motion in such a way that the strand guide exit point always remains the same distance from the braid point. The effective oscillating movement of finger 40 is effected by means of the operator means 55, cam followers 57 and the standing rib 51. As the cam followers track along the rib 51 the lever-like plate 55 is caused to have one end oscillate toward and away from the vertical axis of the braiding machine. This movement causes the push rod 60 to move back and forth and to move the connecting link 61 to and fro. Since push rod 62 is connected to the other end of the bell crank member 61 the motion will be transmitted to the off center axis 63 on push rod 40 causing the element 40 to pivot back and forth about axis 42.

Although this invention has been described in connection with the preferred embodiments, it is apparent that many variations and modifications will now become apparent to those skilled in the art. It is preferred therefore, that the present invention be limited not by the specific disclosure but only by the appended claims.

We claim:

1. In a braiding machine having inner and outer bobbin arrays spaced circumferentially around inner and outer tables mounted for counter-rotation about a vertical axis, the combination comprising:

a. means defining a stationary standing rib cam located beneath the outer table;

b. strand guide means supported on the outer table for pivotal movement about pivot axes which pass through the braid point to provide a strand guide exit point that travels in an arcuate path in which all points contained in the path are equidistant from the braid point; and c. drive means for effecting positive oscillation of said strand guide means in opposite directions about the pivot axes thereof, said drive means including:

i. operator means attached to the underside of the outer table having cam follower means depending therefrom into operative contact with each side of said standing rib cam, a portion of said operator means being positively displaced toward and away from the braiding machine vertical axis as the outer table is rotated; and ii. push rod means operatively connected at one end to said strand guide means and at the other end to that portion of said operator means which is positively displaced, whereby said strand guide means is oscillated.

2. The combination as defined in claim 1 wherein said operator means includes an operator lever which is pivotally attached at one end thereof to the underside of the outer table and which, in turn, has a pair of spaced apart cam followers depending from that side of said lever away from the underside of the outer table and intermediate the ends of said lever for contact with each side of said standing rib cam.

3. The combination as defined in claim 2 wherein said push rod means is connected to said operator lever at a point on the other side of where said followers are attached removed from the point where said lever is attached to the underside of the outer table.

4. The combination as defined in claim 2 wherein said operator lever is a plate-like body whose sides enclose two obtuse and two acute angles and wherein the body is pivotally attached to the underside of the outer table at a point generally contained within one of the acute angles and is pivotally attached to said push rod means at a point generally within the other of the acute angle.

5. The combination as defined in claim 1 wherein said means connecting said push rod means to said strand guide means includes a lever pivoted intermediate the end thereof and connected at one end to said push rod means, and a connecting operably connected at one end to that end of said lever not connected to said push rod means and operably connected at the other end to said strand guide means at a point removed from the pivot axis.

6. The combination as defined in claim 1 wherein said strand guide means is supported on the outer table by means of a bracket which is secured to the underside of the outer table and which extends outwardly and upwardly therefrom.

* * * * *